United States Patent [19]

Giebeler et al.

[11] 4,377,040

[45] Mar. 22, 1983

[54] PROCESS FOR THE MODIFICATION OF WOOD

[75] Inventors: Eberhard Giebeler; Bernhard Bluhm, both of Duisburg; Arnold Alscher, Ladenburg; Klaus Moraw, Duisburg; Gerd Collin, Duisburg; Heinzpeter Nilles, Duisburg, all of Fed. Rep. of Germany

[73] Assignee: Rütgerswerke Aktiengesellschaft, Frankfurt, Fed. Rep. of Germany

[21] Appl. No.: 142,576

[22] Filed: Apr. 21, 1980

[30] Foreign Application Priority Data

Apr. 25, 1979 [DE] Fed. Rep. of Germany ..... 2916677

[51] Int. Cl.[3] ..... F26B 5/04

[52] U.S. Cl. ..... 34/16.5

[58] Field of Search ..... 427/397, 297, 377; 34/16.5

[56] References Cited

U.S. PATENT DOCUMENTS

| | | | |
|---|---|---|---|
| 1,366,225 | 1/1921 | Weiss . | |
| 3,685,959 | 8/1972 | Dunn | 427/397 |
| 3,765,934 | 10/1973 | Gaylord | 427/397 |
| 3,971,139 | 7/1976 | Rochon | 34/16.5 |
| 4,025,663 | 5/1977 | Brandt | 427/397 |

FOREIGN PATENT DOCUMENTS

| | | |
|---|---|---|
| 878553 | 6/1953 | Fed. Rep. of Germany . |
| 910836 | 5/1954 | Fed. Rep. of Germany . |
| 2263758 | 9/1974 | Fed. Rep. of Germany . |

OTHER PUBLICATIONS

The Chemical Dictionary, 6th ed., Rheinhold, N.Y., p. 511.

*Primary Examiner*—Michael R. Lusignan
*Assistant Examiner*—Janyce A. Bell
*Attorney, Agent, or Firm*—Joseph A. DeGrandi; Richard G. Kline; Robert G. Weilacher

[57] ABSTRACT

A process is described for the modification of wood and wood products by heat treatment in a closed, heatable vessel, wherein the water content of the starting material is controlled to be no higher than 10% by weight.

7 Claims, No Drawings

PROCESS FOR THE MODIFICATION OF WOOD

The invention relates to a process for the modification of wood and of wood products made therefrom by heat treatment.

INTRODUCTION AND BACKGROUND

Beside fungus resistance, dimensional stability in the case of changing atmospheric moisture content, a smooth surface and workability are the most important characteristics required; for in the case of dimensional changes, e.g. the sealing and heat insulation function of windows and doors, is no longer guaranteed and in the case of a surface high in stresses and having cracks, the wood is not only more susceptible to maintenance but neither can it be coated with plastics in a satisfactory quality. A smooth surface after coating presupposes a smooth, crackless surface of the material used in the case of modern coating processes, e.g., in extrusion coating techniques. In a plastic coating too, dimensional stability and fungus resistance must be guaranteed in order not to have to fear a destruction of the wood and subsequent separation of the plastic coating in the case of any damage to the coating.

From the German Pat. No. 2 263 758, it is known that as a result of the thermal treatment of wood in the case of a wood moisture content between 15 and 30% and temperatures between 100° and 180° C., a decrease of the swelling may be achieved. In the case of thick pieces of wood however, a formation of cracks in the wood will occur easily in the case of such moisture contents during the thermal treatment, which formation of cracks is the more distinct, the higher the wood moisture and the higher the reaction temperatures. The causes lie in the stresses which develop according to experience in the case of too rapid drying. At the same time beechwood is considerably more sensitive than fir or red firwood; on the other hand, beechwood may experience a considerable increase in value by a crack-free stabilization of its dimension. Thin pieces of wood, such as for example veneers with initial moisture content above 10% will not suffer any formation of cracks during the treatment but they emerge highly corrugated from the treatment. This leads to difficulties in the case of subsequent gluing, for a uniform machine application of the glue is hardly possible then and in the case of the intensities of pressure necessary for the gluing, the formation of a crack occurs frequently. A further disadvantage lies in the long reaction times at temperatures below 180° C., as a result of which the profitability of the process is impaired.

From the German OS No. 2 654 958, it is known furthermore to modify wood by a multi-step, elaborate process in aqueous solution with the addition of surface active substances and alkalies at pressures up to 3 bar and temperatures up to 130° C. In that case an increase of the strength of the wood is achieved and in addition the wood becomes more fungus resistant and more uniform in its coloration. However, in that case, we are dealing with an elaborate and expensive process, especially with a view to the reconditioning of the aqueous solution for reasons of protection of the environment.

SUMMARY OF THE INVENTION

Therefore, it was the task of the present invention to provide a process for the modification of wood which avoids the above mentioned disadvantages. This task is solved by a process for the modification of wood and of wood products made therefrom by a heat treatment in a closed, heatable vessel which is characterized by the water content of the starting material not being higher than 10% by weight. Preferably wood with a water content of 3% to 8% by weight is used.

It developed according to the process of the invention that wood may be modified without there occurring any disadvantageous formation of cracks in the case of thick pieces of wood or any very distinct formation of corrugation occurring in the case of veneers.

According to the process of the invention, one may also operate without problems at temperatures above 180° C. which is accompanied by the advantage of considerably shorter reaction times. Effectively, one would operate at temperatures of 160° to 240° C., especially between 180°–230° C.

Generally, the operating pressures range from 3 to 20 bar, especially from 5 to 10 bar.

The duration of treatment as a rule is from 0.5 to 8 hours; generally the time is shorter, the higher a temperature is selected.

Particularly good results will be obtained according to the process of the invention whenever relatively thick pieces of wood are used; preferably wood with a diameter of at least 2 cm, e.g., wood frames with an edge length of at least 2 cm.

Particularly good results may also be achieved, especially in view of avoiding stresses and pressure gradients, whenever the products escaping from the wood during the thermal treatment are enriched in the reaction vessel. This may be achieved, e.g., by a high degree of filling of the reactor, that is to say by a low relationship of reactor volume to wood volume, preferably lower than 7 and/or by the addition of wood condensate and/or of one or more wood condensate ingredients.

Of the ingredients contained in the wood condensate, such as for example formic acid, acetic acid, furfural, furfuryl alcohol, methanol, or even water, especially acetic acid and/or formic acid are particularly suitable. Also higher alkane carboxylic acids, especially with up to 6 carbon atoms, or else the anhydrides of the above mentioned acids, for example acetic acid anhydride, come into question as additions. The additions at the same time may be inserted into the reaction chamber prior to the heat treatment or they are preferably fed into the reactor from the outside during the treatment. A further possibility also consists in the fact of saturating the wood that is to be treated prior to the treatment with the additives.

The quantity of additive generally is not critical. The sum of the partial pressures should as a rule not exceed 12 bar; under no circumstances should concentrations be reached where a partial condensation of the additives takes place in the reaction vessel.

For reasons of safety and in order to suppress an oxidative decomposition of wood, the oxygen concentration in the reaction vessel is not to exceed 10 volume %. In order to secure as light as possible a shading of the treated wood, it will be effective to exclude oxygen altogether; in that case one will operate in an atmosphere of inert gas, for example under nitrogen.

As a reactor, one uses preferably an autoclave of corrosion resistant material, for example from V2A (1,4541-steel) or V4A (1,4571-steel) steel. The size and dimensioning at the same time is governed by the size of the pieces of wood to be used. The heat supply is accomplished preferably by way of heating coils built into the reactor, by superheated steam for example of 40 bar. In order to improve the heat exchange from the heat carrier into the gas atmosphere and from the gas atmosphere into the wood, a gas circulation in the reaction chamber, for example, by means of a fan or a blower, has turned out to be effective in that case.

A wood modified according to the process of the invention is for example very well suited for outside use, especially as building material for windows and doors. Because of its characteristics, it is also eminently well suited for coating with plastics. As a starting material, one may also use uncut, raw wood. Thus, for example, timber with diameters up to about 15 cm for which hitherto no use had been found and which spoils unused in large quantities, is suitable as raw material at favorable costs. In order to lower the total costs of the process, it will be of advantage not to strip the wood of its bark prior to treatment. After the thermal treatment, the bark comes off easily and represents a desirable grindable raw material which is suitable for example as an extender for glues. The reduction in the reaction times, achievable according to the process of the invention, is considerable. In order to achieve a maximum residual swelling of about 5%, for example in the case of beechwood frames with edge lengths between 30 and 50 mm, the reaction time amounts to 1 to 2.5 hours at a temperature of 200° C.

If not otherwise stated, the temperature data always refer to the Celsius scale, pressure data refer to bar and percentual data to percent by weight.

In case the initial moisture content of the wood material delivered is more than 10% then the wood to be treated has to be dried by a technical drying, e.g. by vacuum drying.

DETAILED DESCRIPTION OF THE INVENTION

Examples

Swelling values given in the examples are determined according to DIN 52 184.

EXAMPLE 1 (with comparative example)

Influence of the initial moisture on modification of veneers

In an autoclave made of 1,4571 steel (diameter 600 mm, length 1500 mm) heated indirectly with steam (40 bar) peeled veneers of the red beech in dimensions of 4×200×1300 mm are treated at 10 bar in a nitrogen atmosphere for 1½ hour at 220° C. The temperature constancy in the autoclave will be achieved after about 10 minutes, since a gas circulation accelerates the heat transfer and the temperature balance. The reaction conditions in case of charge 1 and 2 differ merely in the initial moisture of the veneers.

Results:

Charge 1 (initial moisture 20%):

The maximum swelling capacity (in tangential direction) has been decreased by 58% (mean value). However, the veneers are strongly corrugated (approximately 50 mm out of the plane). In the gluing press therefore, the veneers will crack several times in the direction of the fibers. The boards and laminated wood produced by gluing together the veneers are of low quality as a result of this formation of cracks.

Charge 2 (initial moisture 6%):

The maximum swelling lies at 5.5% (mean value) and has thus been reduced by 56%. The veneers are only slightly corrugated (10–20 mm out of the plane). The glue may be applied uniformly by machines. In the gluing press, no formation of cracks occurs.

EXAMPLE 2

Influence of the steam partial pressure on the modification of veneers

In the autoclave described in Example 1, the peeled veneers of beechwood (4×200×1300 mm) are treated. In the case of the charges 3, 4 and 5, the following are present as common conditions: a temperature of 195° C., a pressure of 10 bar and a residence time of 2½ hours. The experimental conditions differ in the following points:

| | | |
|---|---|---|
| Charge 3 | initial moisture | 0%; nitrogen atmosphere |
| Charge 4 | initial moisture | 5.2%; nitrogen atmosphere |
| Charge 5 | initial moisture | 0%; atmosphere of nitrogen (8.5 bar) and steam (1.5 bar), water was dosed in from the outside and was evaporated in the autoclave. |

Results:

In the case of all three batches, the veneers (14 pieces per batch) emerge slightly corrugated and glueable free of cracks from the batch. The reduction of the swelling capacity in the case of charge 3 amounts to only 35%, in the case of charge 4 already to 48% and in the case of charge 5 to 52%.

This example proves that the presence of steam promotes the stabilization of the dimensions and it is almost irrelevant in this respect whether water is added in doses or reaches the reactor in the form of wood moisture. In order to avoid a strong deformation of the veneers, steam however is added preferably in doses.

EXAMPLE 3

Influence of the pressure on the modification of veneers

In the autoclave described in Example 1, beechwood peeled veneers are treated always for 1 hour at 220° C. in a nitrogen atmosphere. The initial moisture of the veneers is 5.2%. The conditions in case of the charges 6, 7 and 8 only differ in the total pressure which in the case of charge 6 amounts to 1.7 bar, in the case of charge 7 to 6 bar and in the case of charge 8 to 11 bar.

Results:

All veneers are slightly corrugated and may be processed well but are variably modified with regard to their stabilization of dimensions. In the case of 11 bar (charge 8), the swelling capacity has been reduced by 53%, in the case of 6 bar (charge 7) by 44% and in the case of 1.7 bar (charge 6) still only by 34%.

EXAMPLE 4 (WITH COMPARATIVE EXAMPLE)

Influence of the starting moisture of wood on the modification of wood frames

Beechwood frames (50×50×300 mm) are modified in the autoclave (cf. Example 1) in a nitrogen atmosphere for 2½ hours at 200° C. and 10 bar. The wood frames used in five different charges, differ in their moisture contents. All wood frames were free of cracks prior to the treatment.

Result:

| | Moisture % | Swelling Tangential | Bending Strength N/mm² |
|---|---|---|---|
| Charge 9 | 0 | 4.8 ± 0.7 | 95 ± 5 |
| Charge 10 | 5 | 5.3 ± 0.8 | 82 ± 5 |
| Charge 11 | 10 | 4.6 ± 0.4 | 74 ± 7 |
| Charge 12 | 14 | 5.0 ± 0.5 | 74 ± 7 |
| Charge 13 | 22 | 4.9 ± 0.4 | 87 ± 6 |

After the treatment, the wood frames with 0% and 5% initial moisture are free of cracks on the outside and in the inside. About 20% of the wood frames with 10% initial moisture have widths of cracks up to 1 mm in the inside. 30% of the wood frames with a initial moisture of 14% have cracks with a width of the crack of about 3 mm. All wood frames with moisture contents of 22% are strongly cracked in the inside (width of cracks 4–6 mm).

In the maximal residual swelling (see Table), the wood frames with variable starting moisture hardly differ.

EXAMPLE 5

Influence of the thickness of studding on the modification

Wood frames of beechwood of variable dimensions are treated jointly in an autoclave according to Example 1 for 2½ hours at 200° C. in a nitrogen atmosphere. (10 bar). The initial moisture is 0%. The treated wood frames are evaluated with regard to formation of cracks, swelling capacity and bending strength. In the table, also the quotient from relative reduction of swelling ΔQ and relative reduction of the bending strength ΔB is given, which in the case of the most highly modified wood frames, has the greatest value (modification ~ ΔQ/ΔB).

| Wood Frame Dimension mm | Crack Formation | Rel. Reduction of the swelling capacity ΔQ % | Rel. Reduction of the bending strength ΔB % | ΔQ/ΔB |
|---|---|---|---|---|
| 10 × 10 × 300 | none | 28 | 48 | 0.58 |
| 20 × 20 × 300 | none | 42 | 31 | 1.35 |
| 30 × 30 × 300 | none | 57 | 17 | 3.35 |
| 50 × 50 × 300 | none | 66 | 38 | 1.74 |

The example shows an increase in the modification with rising cross sectional plane of the wood frames which are square in their cross section, up to a maximum, which in the case of the conditions selected here lies in the dimensions 30×30 mm, but which in the case of other conditions, may shift.

EXAMPLE 6

Influence of the gaseous wood condensation products on the modification of wood frames Beechwood frames with the dimensions of 30×30×300 mm are modified for 1½ hour at 200° C. and 10 bar. The wood frames used are oven dried but the gas composition in the autoclave varies because water or wood condensate is dosed into the autoclave and are evaporated there at the beginning of the modification. The wood condensate contains 80% of water, 15% of acetic acid, 2% of formic acid and 3% of other components.

| Partial Pressures | Crack Formation | Relative Decrease of the Swelling Capacity, % |
|---|---|---|
| 10 bar nitrogen | none | 34 |
| 7.5 bar nitrogen + 2.5 bar water | none | 55 |
| 7.5 bar nitrogen + 2.5 bar wood condensate | none | 57 |

Further modifications of the invention will be apparent to those skilled in the art from the foregoing description and are intended to be encompassed by the claims which follow.

We claim:

1. A method for the modification of wood in order to obtain dimensional stability which comprises subjecting wood which has a moisture content not greater than 8% to a heat treatment at an elevated temperature of from 160° C. to 240° C. in a closed heatable vessel under pressure, said vessel having been evacuated prior to the heat treatment to exclude oxygen in excess of 10 volume percent and permitting products escaping from the wood during the thermal treatment to remain in the reaction vessel for the entire reaction time, and thereby obtaining a dimensionally stable wood product which will be resistant to formation of cracks.

2. The method of claim 1, wherein the operating pressures range from 3 to 20 bar.

3. The method of claim 1, wherein the treatment ranges from 0.5 to 8 hours.

4. The method of claim 1, wherein the method is carried out in an atmosphere of an inert gas.

5. The method of claim 1, wherein water or steam is injected into the reaction vessel.

6. The method of claim 1, wherein at least one of the group consisting of formic acid, acetic acid, furfural, furfuryl alcohol, methanol, an alkane carbocyclic acid up 6 carbon atoms or an anhydride thereof is present during the heat treatment.

7. The method of claim 1, wherein a ratio of reactor volume to wood volume of lower than 7 is used for treatment of the wood.

* * * * *